United States Patent [19]

Parrilli

[11] 4,308,986

[45] Jan. 5, 1982

[54] TUCK BOX WITH HEADER CARD

[76] Inventor: Gerard A. Parrilli, 1217 Arlington Dr. East, Hanover Park, Ill. 60103

[21] Appl. No.: 136,875

[22] Filed: Apr. 3, 1980

[51] Int. Cl.[3] ..... B65D 5/22

[52] U.S. Cl. ..... 229/33; 206/806

[58] Field of Search ..... 206/806; 229/38, 33, 229/36, 17 B

[56] References Cited

U.S. PATENT DOCUMENTS

| | | | |
|---|---|---|---|
| 1,223,013 | 4/1917 | Wilson | 229/38 X |
| 1,874,705 | 8/1932 | Levkof | 229/33 |
| 1,956,642 | 5/1934 | Einson | 229/17 B X |
| 1,985,990 | 1/1935 | Hanson | 229/33 X |
| 2,512,546 | 6/1950 | Hurndell | 229/33 X |
| 3,126,142 | 3/1964 | Goetz | 229/36 |
| 3,625,411 | 12/1971 | Cote | 229/37 R |
| 3,659,704 | 5/1972 | Collura et al. | 206/806 |
| 3,814,303 | 6/1974 | Smith | 229/38 |
| 3,904,029 | 9/1975 | Koltz | 229/38 |
| 3,945,559 | 3/1976 | Krautsack . | |
| 3,946,936 | 3/1976 | Brown | 229/38 |
| 3,985,232 | 10/1976 | Johnson | 229/38 |
| 4,146,128 | 3/1979 | Hogg et al. | 206/806 |

*Primary Examiner*—Herbert F. Ross

*Attorney, Agent, or Firm*—Jacques M. Dulin

[57] ABSTRACT

A product package (box) comprising a one-piece, precut glue-less, blank having an extended rear panel adapted to be folded about a score line to provide a header card extending from the rear wall of the carton. The extended rear panel header card functions both as a free standing advertising panel and permits the box to be hung from a hanger without obstructing the ad message. The box is set up by interlocking tabs without the use of adhesive.

13 Claims, 6 Drawing Figures

TUCK BOX WITH HEADER CARD

FIELD OF THE INVENTION

The invention relates to a product box having a display panel extending from and integral with one panel of the box. More particularly, the invention relates to one-piece, glueless pre-cut blanks which can be folded into product boxes having header cards functioning both as a free standing point of purchase display card, and to permit hanging the box from hooks if desired.

BACKGROUND

Conventional packaging design includes many variations in box or carton formation. Many product boxes are formed from one-piece, pre-cut blanks which permits ease of assembly. By being one piece, parts loss and parts inventory mismatches are avoided. To be commercially feasible for packaging, one-piece box designs generally require the use of an adhesive on one or more panels to permit box set-up (assembly). A box design that does not need an adhesive for complete construction generally requires extra panels and folding steps, and accordingly uses a greater amount of material. Such a box may lack the strength of a box sealed with an adhesive.

Some variations in box design utilize a header card construction, which serves the dual purpose of allowing the box to be hung from a display hook and also provides point of purchase space for advertising, display or promotional material relating to the product that is within the box. On some current designs the header card is pre-formed as a part of the one-piece construction. In other designs the header card can be attached to the box after it is formed.

Most current box designs utilize either complicated folding patterns or require the use of an adhesive to seal the box together. Applying an adhesive to a portion of the box entails an extra step in the manufacture of the box and when such boxes are produced in quantity, can involve a substantial expense. If such adhesive-employing boxes are prepared well in advance of use, they require substantial storage space and are impractical to ship.

Examples of variations in box design are illustrated in U.S. Pat. Nos. issued to Brown 3,946,936, Smith 3,814,303, Cote 3,625,411, Johnson 3,985,232, and Einson 1,956,642.

The U.S. Pat. No. to Brown 3,946,936 shows a one-piece paperboard box with a header card and requires an adhesive to complete its assembly. The Smith U.S. Pat. No. 3,814,303 shows another box design utilizing a header card and also requires the use of an adhesive. The Cote U.S. Pat. No. 3,625,411 discloses a tube for packaging items of differing dimensions having an internal bracing structure. The Cote box also requires the use of an adhesive for proper set-up. The U.S. Pat. No. to Johnson 3,985,232 discloses a box formed of a one-piece construction having a header card which extends above the top of the box and to the side of the box. The Johnson device also has two tuck flaps and requires an adhesive to assemble. The Einson U.S. Pat. No. 1,956,642 shows a carton for dispensing individual merchandise items formed from a single blank and also requiring an adhesive.

There is a need for a packaging box or carton capable of suitably strong construction and formed of a one-piece blank which does not utilize an adhesive. There is further need for such a box which has a header card formed as an integral part thereof, and is able to be constructed in a minimum number of steps, using a relatively small amount of materials.

THE INVENTION

OBJECTS

It is an object of the invention to produce a product box of simple, one-piece construction, with self-supporting, interlocking foldable panel members, which utilizes a small amount of materials and steps in its construction.

It is an object of this invention to provide a pre-cut box blank formable into a box of suitably strong construction with the use of an adhesive, that when opened will provide ease of access to the contents of said box.

It is another object of this invention to provide a box having a hanger panel so it can be hung on a hook of a merchandise display.

Another object of the invention is to provide a carton of one-piece construction having a point of purchase header card formed from an extension of one of the box panels.

Still other objects will be evident in the following description and the drawing.

SUMMARY OF THE INVENTION

The invention, through the use of a pre-cut, one-piece blank allows a packaging box to be formed of a unique design without the use of an adhesive. The box assembly is accomplished by folding along predesignated score lines and through the use of interlocking flaps and tabs. The final form has a single tuck flap for opening and closing the box.

DETAILED DESCRIPTION OF THE PREFERRED EMBODIMENT

The invention is described in more detail below by way of example and not by way of limitation of the principles of the invention, and with specific reference to the drawings.

Figure 1:
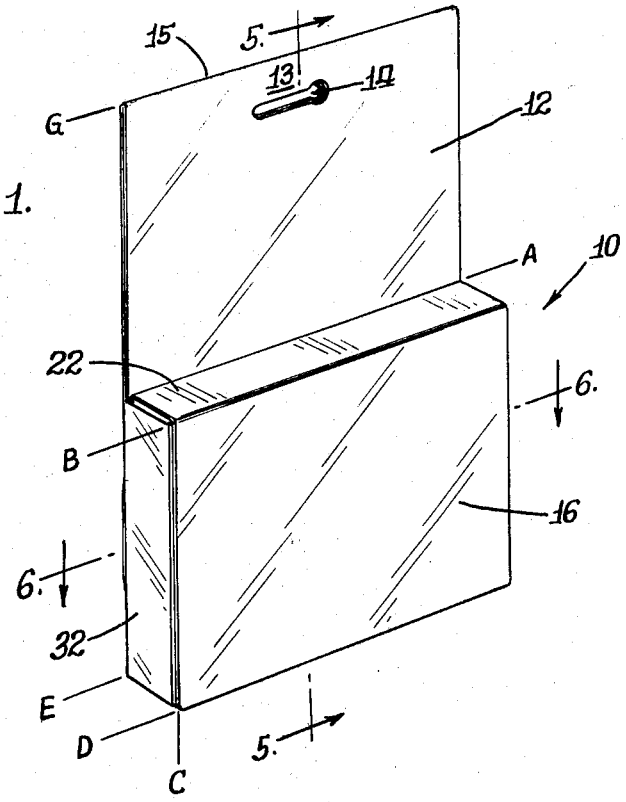
FIG. 1 is a perspective view of a box in accordance with this invention in the assembled configuration.

FIG. 1 illustrates box 10 in its fully assembled form. Box 10 comprises header card 12 and front panel 16 forming two fully exposed planar surfaces, which provide ample room for the imprinting of point of purchase sales and promotional information for the product contained within box 10, e.g., card games, etc.

Figure 2:
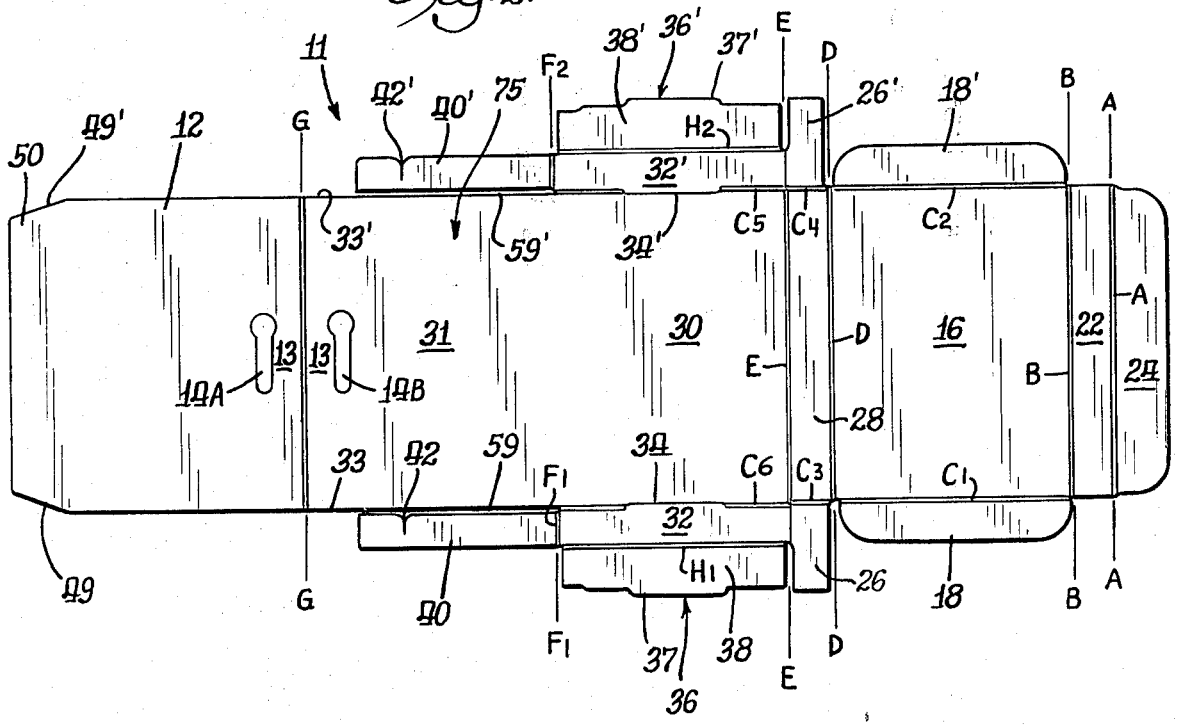
FIG. 2 is a plan view of the one-piece, precut blank in an unfolded position.

FIG. 2 shows the invention in its unfolded state as a box blank consisting essentially of a sheet of foldable material, a plurality of panels, flaps and tabs defined between the margins thereof and score lines therein, where the sheet has a first total length dimension greater than a second overall width dimension to form a generally rectangular blank in the sheet and being bounded by a first and a second end margin and at least two side margins.

Box 10 can be hung vertically from a merchandise display rack by virtue of hanger aperture 14 disposed near the upper marginal edge 15 of header card 12 to allow a maximum of uninterrupted print space, yet provide a strong enough web 13 to support the weight of the box contents. The tabular design of carton 10 permits convenient stacking of the boxes on a conventional display hook, and also permits free standing vertical or horizontal stacking on a shelf.

In the preferred embodiment, the box 10 is formed from an elongated pre-cut blank. This blank consists of a number of generally rectangular panels separated by various vertical and horizontal score lines. As shown in FIG. 2, blank 11 has as main panels, front panel 16, back panel 75, and header card panel 12. Back panel 75 is divided into two portions shown in FIGS. 2 and 3 being lower portion 30 and upper portion 31. Score lines $C_1$ through $C_6$ delimit the interlocking members from the main panels.

Figure 3:
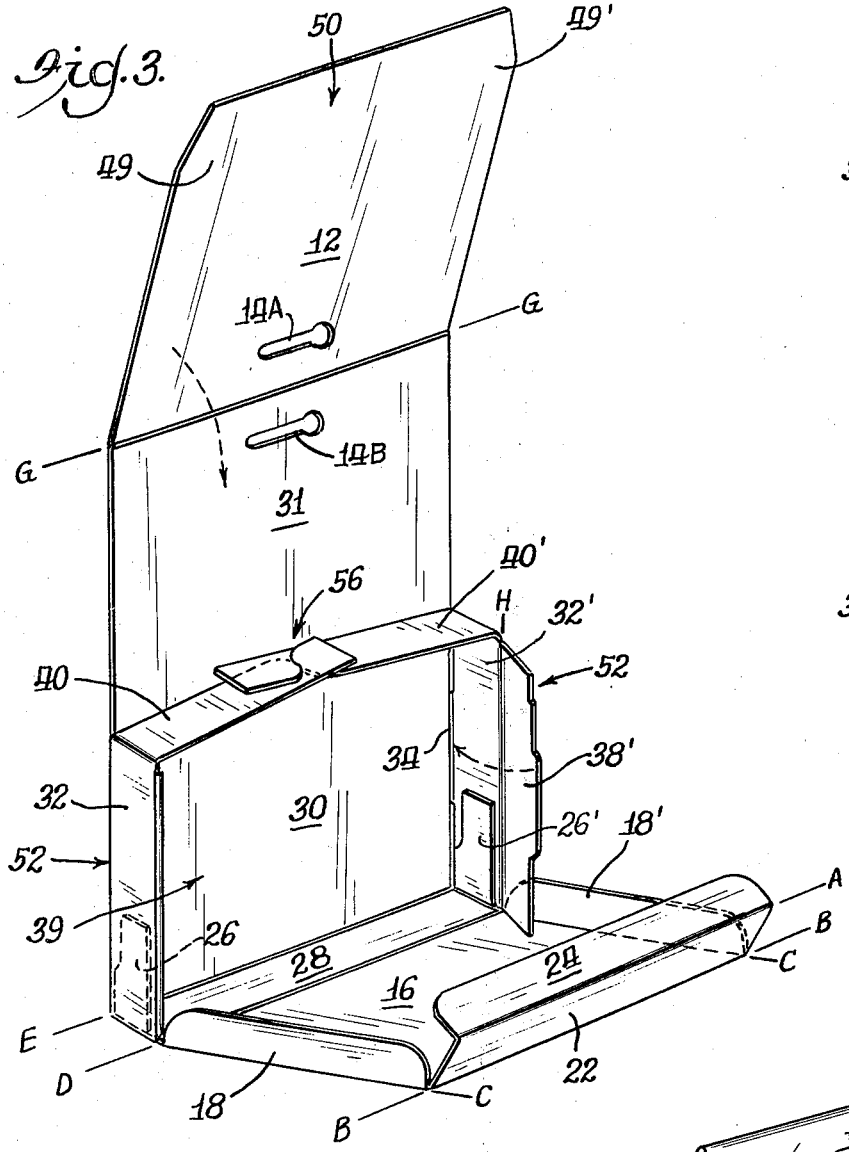
FIGS. 3 and 4 illustrate the box at separate phases of set-up.

As best seen in FIG. 3, the box includes side panels 32, 32', bottom panel 28, back panel 75 with its header card extension portions 31 and 12, and interlocking tabs described in more detail below.

FIG. 2 shows one side of blank 11 from which the box is assembled. Blank 11 has score lines A through H thereon which define and delineate the various panels and facilitate folding of the box in the correct manner. Blank 11 also has preformed tabs and flaps contiguous with back panel 30, bottom panel 28 and front panel 16. These tabs and flaps, when folded, form the sides 32, 32', the top panel 22, and the tuck lip 24 of the box. They also provide proper spacing and interlocking features to permit omission of glue.

Top panel 22 is disposed at one end of front panel 16 and delineated between score lines A and B. Lying between score line A and the outer margin of blank 11 is tuck flap 24 which has slightly rounded edges to assist box closure, and may further have a length less than panel 22.

Panel 22 is joined to front panel 16 along score line B, and when folded, forms a right angle to panel 16 as the top of box 10.

Figure 4:
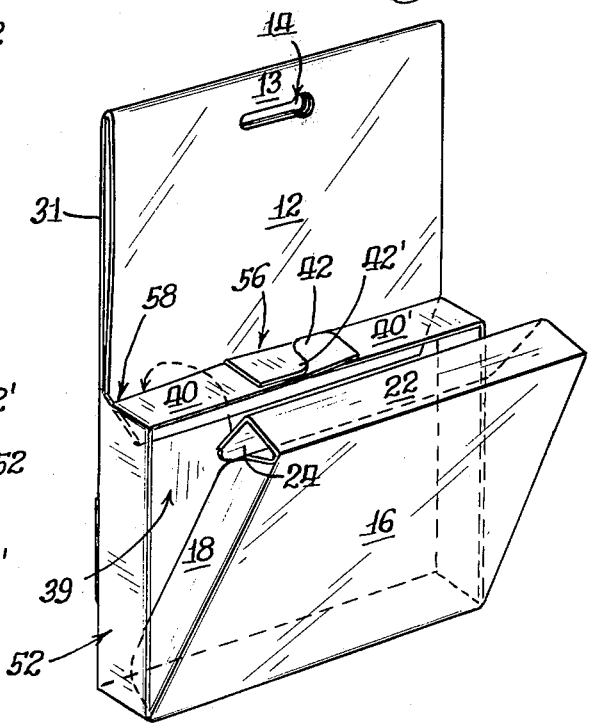

Front panel 16 has side tuck flaps 18, 18' connected thereto along side margin score lines $C_1$ and $C_2$. These flaps when folded at right angles to front panel 16, form insert flaps of front panel 16 for sealing box 10 (FIG. 4). Bottom panel 28 is joined to front panel 16 along score line D and joined to back panel 30 along score line E.

Bottom interlock tabs 26, 26' are connected to bottom panel 28 along score lines $C_3$ and $C_4$. Bottom interlock tabs, when folded at right angles to bottom panel 28 interlock between side panel portions 38, 38' and 32, 32' respectively. This interlock prevents box from unfolding completely when the top tuck flap 24 is slipped out of its closure position (FIG. 1 to FIG. 4), and the front panel 16 is opened.

Back panel 30 has tab receiving perforations or cuts 34, 34' along score lines $C_5$ and $C_6$ which are formed to receive and retain locking tabs 36, 36'. These cuts are medial between score lines E and $F_1$, $F_2$. Side panels 32, 32' connect along score lines $C_5$ and $C_6$ to back panel portion 30 and are defined between $C_5$ and $C_6$ and score lines $H_1$ and $H_2$. Connected to side panels 32, 32' along score lines $H_1$ and $H_2$ are side interlock panels 38, 38' which have tabs 36, 36' defined in the outer marginal edges 37, 37' thereof. These tabs 36, 36' matingly engage slits 34, 34' so that side panel assembly rigidly locks bottom interlock tabs 26, 26' between panels 32 and 38, and 32' and 38' respectively.

Top interlock spacer tabs 40, 40' are connected to side panels 32, 32' along score lines $F_1$ and $F_2$ and extend parallel to the side margins 33, 33' of back header card portion 31. The interlock tabs 40, 40' have notches 42, 42' cut therein.

Back header card portion 31 has aperture 14B punched therein, and is joined to header card panel 12 at score line G. Header card panel 12 has a similar, aligned hanger aperture 14A punched therein to correspond to aperture 14B when header card 12 is folded about score G. Header card 12 has tapered edges 49, 49' to define a tuck portion 50 at end thereof which, when 12 is folded, secures header card 12 into place, parallel to back portion 31.

Figure 5:
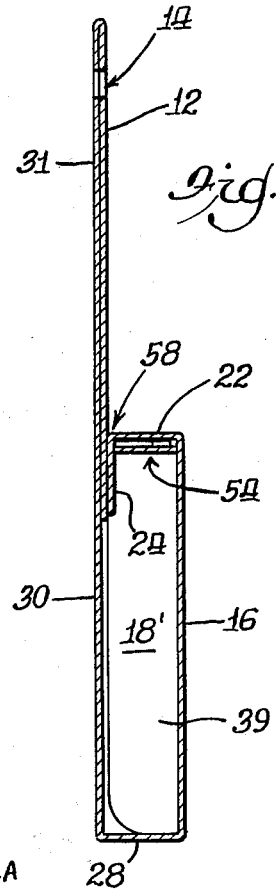
FIG. 5 shows a side sectional view of the box fully assembled along lines 5—5 of FIG. 1.
Figure 6:
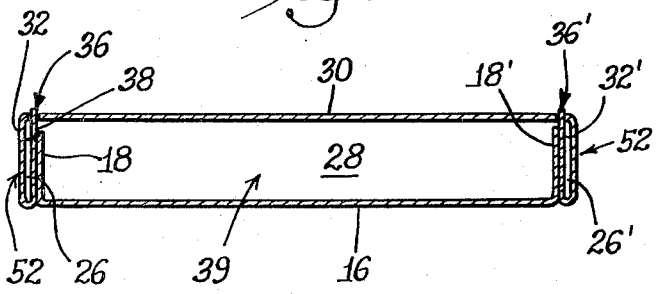
FIG. 6 shows a transverse sectional view of the assembled box along line 6—6 of FIG. 1.

To assemble box 10, blank 11 is folded along the score line in the manner defined below, reference being made to FIGS. 2, 3, 4 and 1 in sequence, with FIGS. 5 and 6 showing the section views.

In assembly of box 10, flaps 18, bottom interlock tabs 26, 26' and side panel portions 32, 32' are folded inwardly along crease lines $C_1$–$C_6$ in the same direction and at right angles to the plane of blank 11. Blank 11 is then folded along score line E such that bottom panel 28 forms a right angle to back panel 30. Bottom panel 28 is thus folded inwardly in the same direction that side panels 32, 32' are folded.

Bottom interlock tabs 26, 26' are aligned parallel to and inside of side panels 32, 32' along score lines $C_5$ and $C_6$ as shown in FIG. 3. Side panel locking portions 38, 38' are then folded about crease lines $H_1$ and $H_2$ such that locking tabs 36, 36' are inserted into mating slits 34, 34' in score line $C_5$ and $C_6$. This locks bottom interlock tabs 26, 26' into place. This locking firmly holds bottom panel 28 at a right angle to pack panel 30 and forms side wall assembly 52 shown in FIGS. 3 and 6. Side walls 52 are at right angles to bottom panel 28.

As seen in FIG. 3, header panel 12 is folded downwardly and inwardly (toward the partly formed box) along crease line G, and tab portion 50 is extended into the product space 39 of the box. Folding header panel 12 in this manner causes hanger apertures 14A and 14B to align and form hanger opening 14 shown in FIGS. 1, 4 and 5, and completes assembly of the double thickness header card panel combination 12, 31.

Then top interlock spacer tabs 40, 40' are folded at right angles to side panels 32 along crease lines $F_1$ and $F_2$ and are interlocked at slitted notches 42, 42', forming tab support 56. Folding in this manner forms tab support 56 at right angles to the back panel 30 and the folded header card portion 12, 31. The interlocking of top tabs 40, 40' at notches 42, 42' supports side walls 52 and retains them in position, preventing their outward movement from the vertical line of box 10.

At this point, five of the six sides of box 10 have been assembled forming product containing volume or space 39. Box 10 is now ready to receive the merchandise which it is intended to contain. For example, a box $4\frac{3}{4}'' \times 3\frac{5}{8}'' \times \frac{3}{4}''$ is particularly suited to hold a card game such as the "101" marketed by the Gerry Products Company. After the merchandise has been inserted, the final folding can be completed, and box 10 will be closed and ready for shipping and display with the merchandise contained therein.

Flaps 18, 18' which have already been folded at right angles to front panel 16 along crease lines $C_1$ and $C_2$ are positioned as shown in FIG. 4 so that they may be inserted inside product space 39 and adjacent side walls 52. Box 10 is closed by folding front panel 16 at a right angle to bottom panel 28 along crease line D. This fold causes flaps 18 to be inserted to the inside of side walls 52 and positions top panel 22 and tab 24 for securing box 10.

Tab 24 is then inserted in gap 58 formed between interlocked tab assembly 56 and header panel 12. Note that margins 59, 59′ of top interlock tabs 40, 40′ are spaced from margins 33, 33′ of header panel portion 31 (FIG. 2). This last fold securely closes box 10. It should be noted that such closure was achieved without the use of an adhesive and in a relatively small number of steps.

FIG. 6 is a section view of the closed box along lines 6—6 of FIG. 1 showing flaps 18, 18′ positioned adjacent side walls 52. Space 39 contains the desired merchandise.

FIG. 5 is a section view of the closed box along lines 5—5 of FIG. 1 showing the folded arrangement of header card assembly 12, 31 in relation to back panel 30. Closure tab 24's positioning with respect to header card assembly 12, 31 is such that top panel 22 may be opened without disturbing the positioning of header card assembly 12, 31. Also FIG. 5 illustrates the relationship between the interlocking top interlock spacer tabs 40, 40′ and top panel 2. Top panel 22 is parallel to the plane formed by the interlocking top spacer tabs 40, 40′. Closure tab 24 is folded at a right angle to top panel 22 and parallel to tab 50 of header card assembly 12, 31. FIG. 5 also shows product space 39 created by the various panels after folding to contain the desired merchandising items.

It is important to note that the main panels of box 10 and the corresponding interlocking means, need not be limited to a rectangular shape. Any general polygonal shape may be used to practice the invention described herein including a square, trapezoid, triangle or rhombus.

It is also important to note that an adhesive sealing means can be used on flaps 26 and 26′ to seal the box instead of the interlocking mechanism and also, that adhesive can be used on flaps 32 and 32′ and/or on flaps 38 and 38′ instead of the tab 36 and 36′ and seam 34 and 34′ arrangements.

It should be understood that various other modifications within the scope of this invention can be made by one of ordinary skill in the art without departing from the spirit thereof. I therefore wish my invention to be defined by the scope of the appended claims as broadly as prior art will permit, and in view of this specification if need be.

I claim:

1. A box blank comprising a sheet of foldable material having a plurality of panels, flaps and tabs defined between the margins thereof and score lines therein;

(a) said sheet having a first total length dimension greater than a second overall width dimension to form a generally rectangular blank in said sheet and being bound by a first and a second end margin and at least two side margins;

(b) said first end margin having a tuck flap defined between said first end margin and a first fold line spaced therefrom;

(c) said first tuck flap having joined thereto along said first fold line a top panel defined by a second fold line spaced from said first fold line;

(d) said top panel having joined thereto along said second fold line a front panel defined by a third fold line spaced from said second fold line;

(e) said front panel having joined thereto a bottom panel along said third fold line, defined by a fourth fold line spaced therefrom;

(f) said bottom panel having joined thereto a back panel along said fourth fold line defined by a fifth fold line spaced therefrom;

(g) said back panel being divided into a first portion and a second portion where said first portion is adjacent the fourth fold line and said second portion is adjacent the fifth fold line;

(h) said back panel having joined thereto a header card defined between said fifth fold line and the second end margin; and (i) said back panel having joined thereto along each side margin of the first portion, a side wall locking means and a top wall locking means, whereby when said box blank is constructed said side wall locking means and said top wall locking means interact with said panels, tuck flap and header card to form a fully formed box.

2. The box blank of claim 1 wherein said side wall locking means of each side margin comprises:

a first side flap defined by a sixth fold line spaced from said side margin, an opposing end adjacent the side margin and the sixth fold line, and a seventh fold line opposing said end adjacent the side margin and sixth fold line, where said end adjacent the side margin is also adjacent the first portion of said back panel and where the seventh fold line is adjacent the second portion of said back panel, a seam cut intermediate the boundaries of said first side flap and colinear with said side margin, a second side flap joined to said first side flap along an eighth fold line, said second side flap having an outermost end thereof, and a tab extending from said outermost end.

3. The box blank of claim 2 wherein said top wall locking means of each side margin comprises:

a third flap joined to said first flap along said seventh fold line and adjacent the second portion of said back panel and having a length greater than one-half the width of the back panel, and a means for joinably securing each said third flap thereby forming a supporting member.

4. The box blank of claim 1 where said front panel has joined thereto along each side thereof a fourth flap defined between side margins thereof and ninth fold lines spaced therefrom.

5. The box blank of claim 4 where said bottom panel having joined thereto along each side an extended tab defined between each side margin and tenth fold lines spaced therefrom.

6. The box blank of claim 5 where said extended tabs are folded 90 degrees to said bottom panel and said bottom panel is folded 90 degrees to said back panel along the fourth fold line such that said extended tabs are normal to and adjacent the sixth fold lines of said first side flaps, said first side flaps are folded 90 degrees to said back panel such that said first side flaps are adjacent said extended tabs, said second side flaps are folded 180 degrees such that said second side flaps are adjacent the inner planes of said extended tabs and such that said second side flap's tabs are joined in mating engagement with said seam cuts, thereby locking said bottom panel in its folded position.

7. The box blank of claim 2 where said header card has a dimension from the fifth fold line to the second end margin greater than the dimension from the fifth fold line to where the seventh fold lines join said side margins of said back panel.

8. The box blank of claim 7 where said header card is folded 180 degrees about the fifth fold line such that the plane of said header card is adjacent the plane of the second portion of said back panel.

9. The box blank of claim 8 where said third flaps are folded 90 degrees towards each other and secured together by said securing means.

10. The box blank of claim 9 where said securing means is an adhesive applied to said third flaps, whereby said third flaps when folded and adhered together form a supporting member across the width of said back panel.

11. The box blank of claim 9 where said securing means is a notch in each of said third flaps where said notches are proportionally spaced on said third flaps such that the distances from each notch to each respective seventh fold line total the width of the first portion of said back panel, whereby said notches interlock upon folding said third tabs thereby forming a supporting member across the width of said back panel.

12. The box blank of claims 10 or 11 where said front panel is folded 90 degrees to said folded bottom panel and said top panel is folded 90 degrees to said folded front panel and said tuck flap is folded 90 degrees to said folded top panel and inserted in between said supporting panel and said back panel thereby closing said box.

13. The box blank of claim 1 where the second portion of said back panel has a first aperture therein and where said header card has a similar second aperture therein, where said second aperture is in alignment with said first aperture such that when the header card is folded 180 degrees about the third fold line, the first and second apertures form a single aperture.

* * * * *